US008172384B2

(12) United States Patent
Iwakura

(10) Patent No.: US 8,172,384 B2
(45) Date of Patent: May 8, 2012

(54) RECORDING APPARATUS

(75) Inventor: Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 12/536,140

(22) Filed: Aug. 5, 2009

(65) Prior Publication Data

US 2010/0034558 A1 Feb. 11, 2010

(30) Foreign Application Priority Data

Aug. 7, 2008 (JP) ..... 2008-204515

(51) Int. Cl.
*B41J 2/175* (2006.01)

(52) U.S. Cl. ..... 347/86; 347/20; 347/49; 347/50; 347/84; 347/85; 347/87; 347/108

(58) Field of Classification Search ..... 347/49, 347/50, 86
See application file for complete search history.

(56) References Cited

U.S. PATENT DOCUMENTS 5,748,210 A * 5/1998 Watanabe et al. ..... 347/50
6,250,750 B1 * 6/2001 Miyazawa et al. ..... 347/87
6,312,105 B1 * 11/2001 Miyauchi ..... 347/49
6,502,917 B1 * 1/2003 Shinada et al. ..... 347/19
6,736,486 B2 * 5/2004 Nakamura et al. ..... 347/49
6,779,880 B1 * 8/2004 Kulpa et al. ..... 347/86
7,275,809 B2 * 10/2007 Uwagaki et al. ..... 347/49
7,384,124 B2 * 6/2008 Yang ..... 347/37
7,452,066 B2 * 11/2008 Tsuji ..... 347/108
7,607,769 B2 * 10/2009 Umeda et al. ..... 347/85

FOREIGN PATENT DOCUMENTS

JP 2001-341320 A 12/2001
JP 2005-335230 A 12/2005
JP 2007-50527 A 3/2007

* cited by examiner

*Primary Examiner* — Ryan Lepisto

(74) *Attorney, Agent, or Firm* — Canon U.S.A., Inc. IP Division

(57) ABSTRACT

An apparatus includes a carriage on which a head is removably mounted, a cover on the carriage configured to be movable to a first position where the head is fixed to the carriage and to a second position where the head can be removed from the carriage, and a lever configured to press the head mounted on the carriage by rotating with the cover pushed by a part of the cover when the cover is moved from the first position to the second position, wherein a rotational axis of the lever and a rotational axis of the cover are coaxial with each other.

11 Claims, 11 Drawing Sheets

--PRIOR ART--

--PRIOR ART--

RECORDING APPARATUS

BACKGROUND OF THE INVENTION

1. Field of the Invention

The present invention relates to a recording apparatus equipped with a carriage on which a recording head is removably mounted.

2. Description of the Related Art

There are serial type recording apparatuses that perform recording by scanning a recording head in a main-scanning direction intersecting a conveying direction (sub-scanning direction) of a sheet. In the recording apparatuses of the serial type, images are recorded on the sheet using the recording head mounted on a carriage that moves in the main-scanning direction.

Upon finishing recording for one line, a sheet is conveyed at a predetermined pitch, and then recording of the next line is performed. Thus, recording on the entire sheet is performed by repeating this operation.

FIGS. 11A and 11B illustrate a mounting mechanism of a recording head in the conventional ink jet recording apparatus. FIG. 11A illustrates a state where the recording head is fixed to a carriage. FIG. 11B illustrates a state where mounting and removing of the recording head with respect to the carriage are allowed.

A recording head 109, which is formed as a cartridge, performs recording onto a sheet. A carriage 151 includes the recording head 109 thereon. A head cover 152 securely fixes the recording head 109 to the carriage 151. The lever 157 is used to push out the recording head 109 that is fixed to the carriage 151 interlocking with a movement of the head cover 152.

A rotation fulcrum of the head cover 152 is disposed at an upper side of a rotation fulcrum of the lever 157. When the head cover 152 is opened from the closed state thereof, an end of the lever 157 abuts against a top surface of the head cover 152. Accordingly, the lever 157 rotates so as to be able to push out the recording head 109.

In the state illustrated in FIG. 11A, the lever 157 is located between the recording head 109 and the carriage 151 due to its own weight. Further, in the state illustrated in FIG. 11B, the lever 157 is at a rotated position, so that an electrode portion of the recording head 109 and an electrical contact portion of the carriage 151 can be prevented from coming into inadvertent contact with each other.

Firstly, in a conventional example described above, a supporting shaft for rotation of the head cover 152 and a supporting shaft for rotation of the lever 157 are spaced apart from each other. As a result, a total length of the lever 157 comprises a distance between the supporting shafts and a length of a head portion. Accordingly, it is difficult to further reduce the size of the apparatus.

Secondly, in a state where the recording head 109 is fixed by the head cover 152 to the carriage 151, a part of the lever 157 protrudes from the head cover 152. Therefore, a user may inadvertently touch the lever 157 while the recording head 109 is mounted on the carriage 151. If the user touches the lever 157, the lever 157 and the recording head 109 abut against each other, and thus the positioning of the recording head 109 relative to the carriage 151 becomes unstable. Then, an accuracy of images recorded by the recording head 109 may deteriorate, and electrical connection between the recording head 109 and the carriage 151 may become unstable.

Thirdly, in a state where the recording head 109 is mounted on the carriage 151, the lever 157 is supported only by the supporting shaft and not fixed. As a result, the lever 157 may move due to the movement of the carriage 151, and the lever 157 may hit the side of the recording head 109 or the carriage 151 and generate a rattling noise.

SUMMARY OF THE INVENTION

According to an aspect of the present invention, a recording apparatus includes a carriage on which a recording head is removably mounted, a cover, provided rotatably on the carriage, configured to be movable to a first position where the recording head is fixed to the carriage and to a second position where the recording head can be mounted on or removed from the carriage, and a lever configured to be rotatable independently of the cover, and to press the recording head mounted on the carriage by rotating with the cover pushed by a part of the cover when the cover is moved from the first position to the second position, wherein a rotational axis of the lever and a rotational axis of the cover are coaxial with each other. According to another aspect of the present invention, a apparatus includes a carriage on which a head is removably mounted, a cover on the carriage configured to be movable to a first position where the head is fixed to the carriage and to a second position where the head can be removed from the carriage, and a lever configured to press the recording head mounted on the carriage by rotating with the cover pushed by a part of the cover when the cover is moved from the first position to the second position, wherein a rotational axis of the lever and a rotational axis of the cover are coaxial with each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
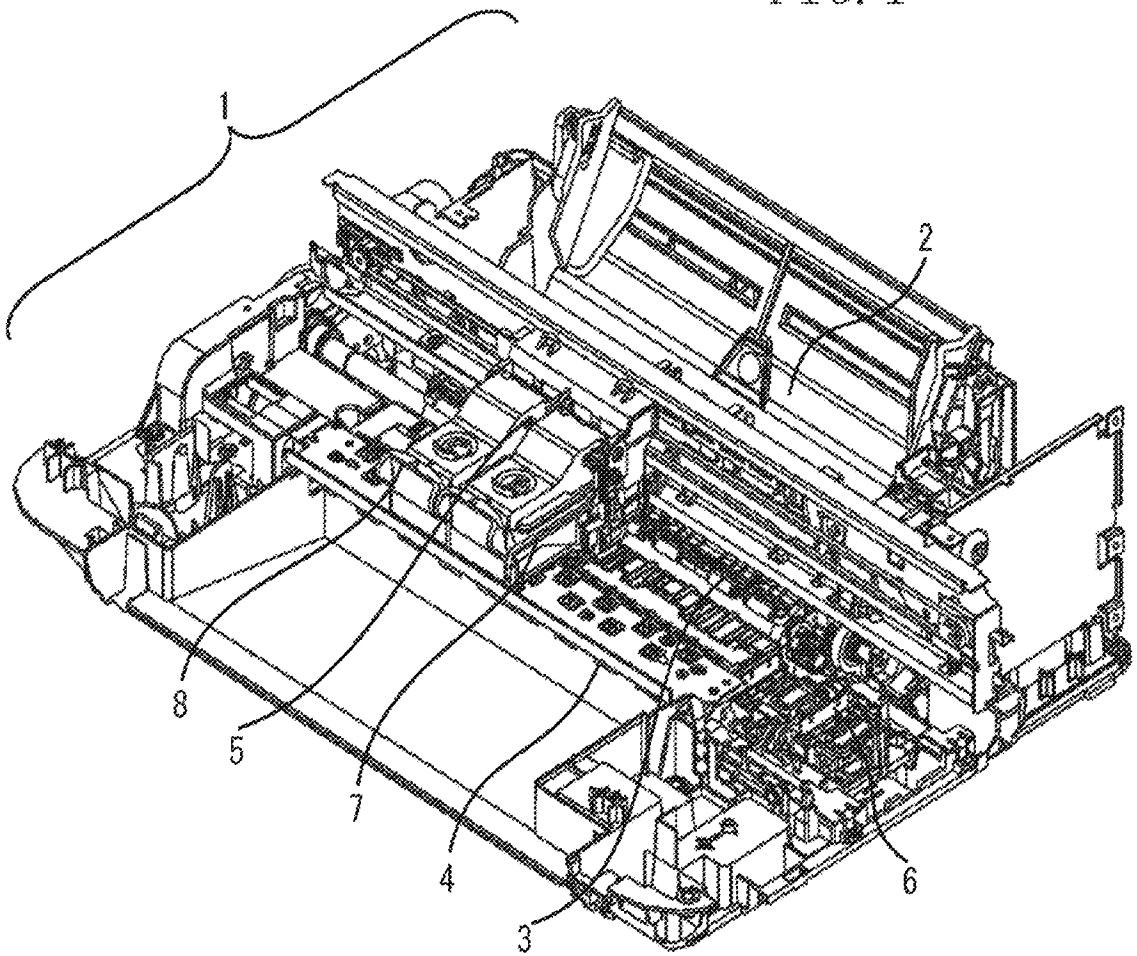
FIG. 1 is a perspective view of a recording apparatus according to an exemplary embodiment of the present invention.

FIG. 1 is a perspective view of an ink jet printer (recording apparatus) according to an exemplary embodiment of the present invention. A recording apparatus 1 according to the present exemplary embodiment includes a sheet feed unit 2, a conveyance unit 3, a sheet discharge unit 4, a carriage unit 5, and a recovery unit 6. In a carriage 51 (FIG. 2) of the carriage unit 5, a plurality of recording heads formed in a cartridge for discharging ink by an ink jet system are mounted.

The recording head includes a black head 7 for discharging black ink and a color head 8 for discharging color inks that are detachably mounted. The color inks include three color-inks, such as yellow ink, magenta ink, and cyan ink. However, the type of colors and the number of colors are not limited thereto.

In the recording apparatus 1, a sheet that has been fed by the sheet feed unit 2 is conveyed by the conveyance unit 3. Then, while the carriage 51 on which the black head 7 and the color head 8 are mounted moves in a direction intersecting a conveying direction of the sheet, inks are discharged onto the sheet from the black head 7 and the color head 8.

Recording on the entire sheet is performed by repeating the movement of the carriage 51 in the main-scanning direction and the conveyance of the sheet by the conveyance unit 3. Upon finishing recording on the entire sheet, the sheet is discharged by the sheet discharge unit 4 to the outside of the recording apparatus 1. Further, a recovery operation of the recording head is performed by the recovery unit 6 at a predetermined timing.

Figure 2:
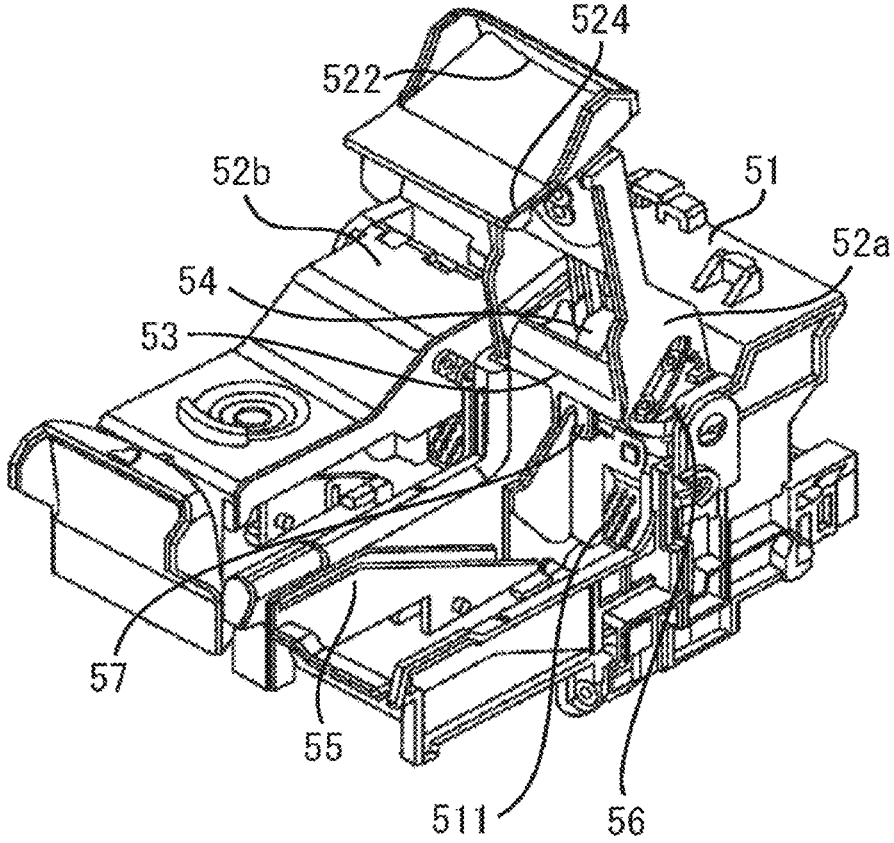
FIG. 2 is a perspective view of a carriage unit of the recording apparatus illustrated in FIG. 1.

Next, the carriage unit 5 according to the present exemplary embodiment will be described. FIG. 2 is a perspective view of the carriage unit 5 of the recording apparatus illustrated in FIG. 1. In the carriage 51, the black head cover 52*a* for fixing the black head 7 and the color head cover 52*b* for fixing the color head 8 are provided.

The black head 7 and the color head 8 are also referred to as recording heads (or a recording head). The black head cover 52*a* and the color head cover 52*b* are also referred to as head covers 52.

A head set cam 53 slides to contact a top surface of the recording head when the recording head is fixed. Between the head cover 52 and the head set cam 53 there is disposed a head set spring 54 that generates a spring force for fixing the recording head to the carriage 51.

A front cover 55 constitutes a space surrounding the recording head when the recording head is fixed to and mounted on the carriage 51. In a state where the head cover 52 is closed, an engaging portion 524 of the head cover 52 is engaged with the front cover 55. A spring 56 is disposed between the carriage 51 and the head cover 52, so that the cover 52 is urged in an opening direction by the spring force of the spring 56 (in a counterclockwise direction in FIG. 2).

A lever 57 pushes out the recording head from behind, when the head cover 52 is opened. An electrode portion 511 (contact portion) makes electrical contact with the black head 7.

In FIG. 2, the black head cover 52*a* is in an open state. From this state, a user can bring the black head cover 52*a* into a closed state by placing the user's fingers on an operation portion 522 thereof to rotate the black head cover 52*a*. The black head cover 52*a* is closed like the color head cover 52*b* illustrated in FIG. 2.

When the black head cover 52*a* is in a closed state, an engaging portion 524 of the head cover 52*a* can be disengaged from an engaging portion of the front cover 55 by pushing the operation portion 522. As described above, the black head cover 52*a* is urged in its opening direction by the spring force of the spring 56. Accordingly, when an engagement with the front cover 55 is released, the black head cover 52*a* rotates to the full open state. The color head cover 52*b* is configured similarly to the black head cover 52*a*.

Figure 3A:
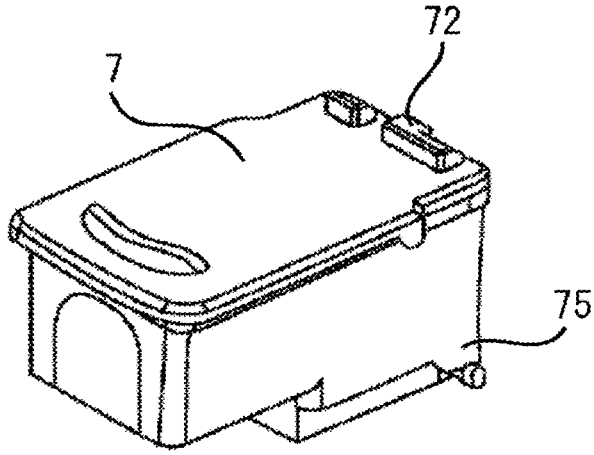
FIGS. 3A and 3B are perspective views of a black head.
Figure 3B:
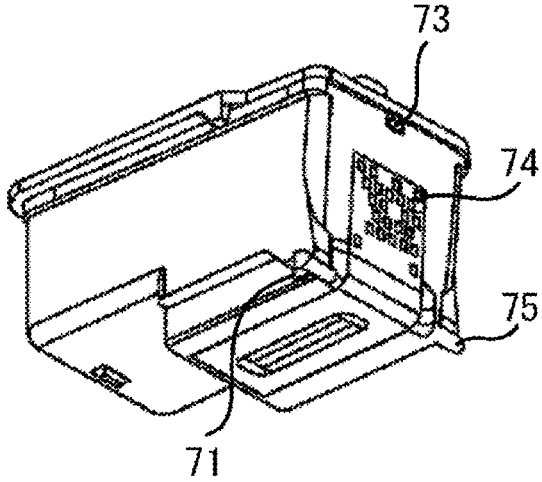

FIGS. 3A and 3B are perspective views of the black head 7. In a state where the black head 7 is fixed to the carriage 51, an electrode portion 74 disposed at a head side electrically contacts the electrode portion 511 of the carriage 51. In a state where the black head 7 is fixed to the carriage 51, the head set cam 53 contacts a pressing portion 72 of the black head 7. Then, the recording head is steadily fixed to the carriage 51 by the spring force of the head set spring 54.

A positioning portion 71 is used for positioning the recording head in the carriage 51. An abutting portion 73 abuts against the carriage 51. A guiding portion 75 contacts the carriage 51, when the black head 7 is fixed to the carriage 51.

Figure 4:
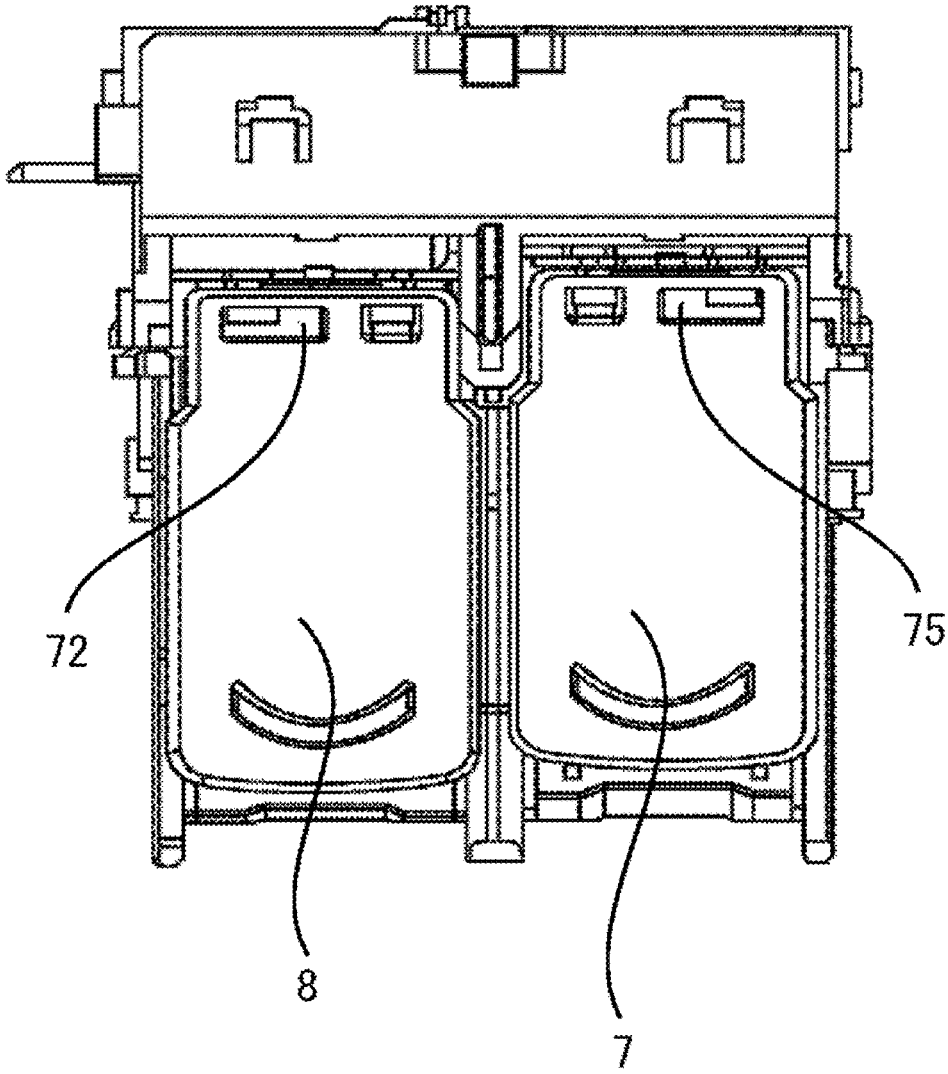
FIG. 4 is a plan view illustrating a state where a black head and a color head are mounted on a carriage, but head covers thereof are not illustrated.

FIG. 4 is a plan view illustrating a state where a black head 7 and a color head 8 are mounted on a carriage, but head covers thereof are not illustrated. That is, a plurality of recording heads can be mounted on the carriage 51.

As illustrated in FIG. 4, in the present exemplary embodiment, the color head 8 is located at downstream side in a conveying direction of the sheet relative to the black head 7. Their positional difference in the conveying direction of the sheet is made based on the factors such as difference in speed of fixing of ink, difference in the number of nozzles to be used per one scanning of the carriage 51, difference in presence/absence of borderless recording, and the like.

Figure 5:
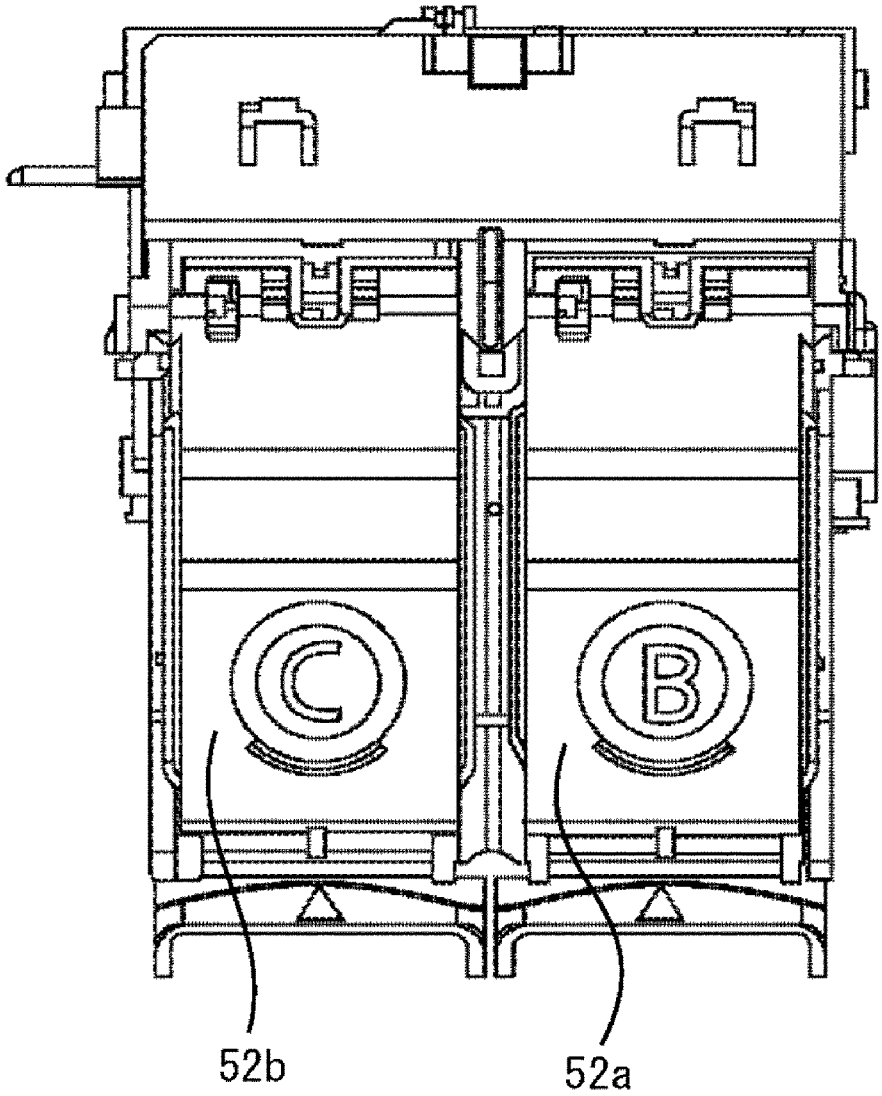
FIG. 5 is a plan view illustrating a state where the black head with a black head cover and the color head with a color head cover are mounted.

FIG. 5 is a plan view illustrating a state where the black head with a black head cover and the color head with a color head cover are mounted on the carriage unit 5. As illustrated in FIG. 5, the black head cover 52*a* and the color head cover 52*b* are similarly positioned in the conveying direction of the sheet for enhanced operability of users, and improved appearance.

The rotation fulcrums of the black head cover 52*a* and the color head cover 52*b* are designed to be located at upperstream side of a pressing portion 72 of the black head 7 in the conveying direction of the sheet and to be coaxial with each other. Further, a position of the engaging portion 524 of the black head cover 52*a* and the color head cover 52*b* is designed to be located at a similar position in the conveying direction of the sheet.

Additionally, the head set cam 53 and the head set spring 54 to be used in the black head 7 are designed to have different shapes from the ones to be used in the color head 8, according to the difference in positions of the black head 7 and the color head 8.

Figure 6B:
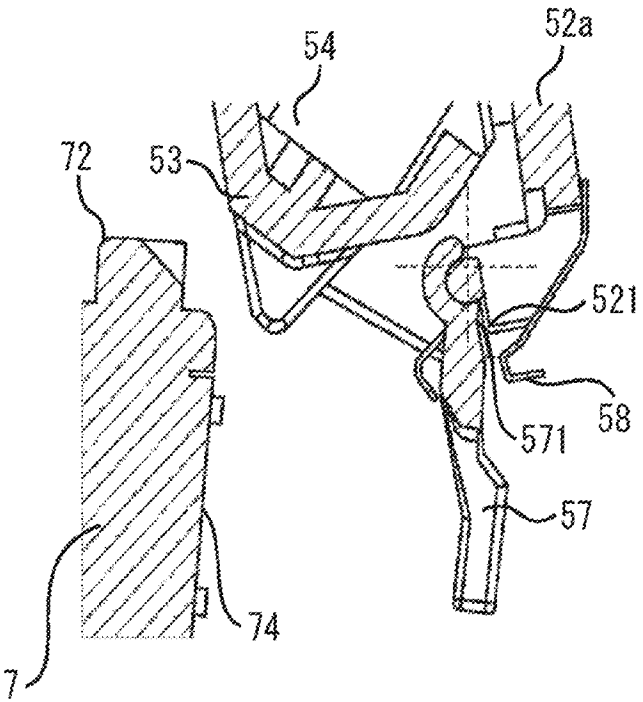
FIGS. 6A and 6B are cross-sectional views illustrating a state where the black head cover is opened and the black head is inserted into the carriage.
Figure 6A:
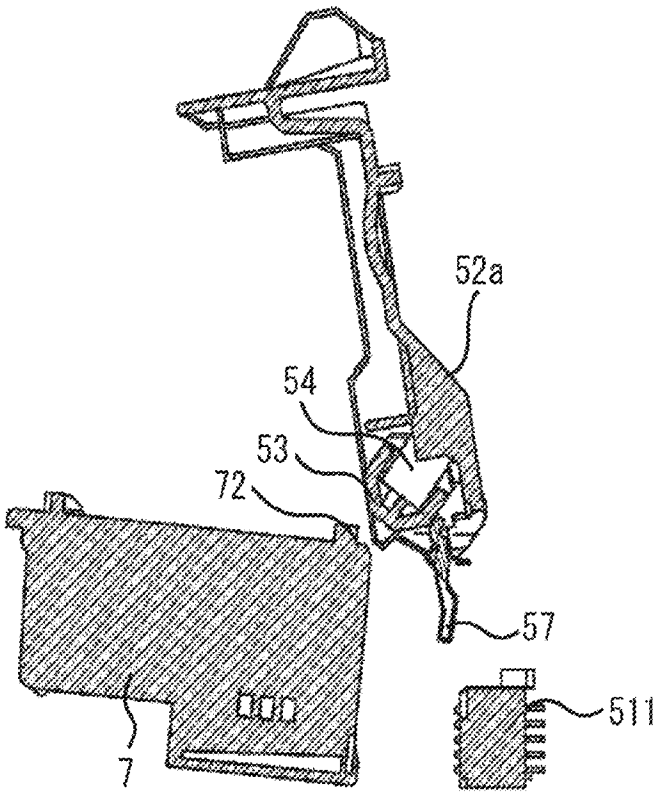

Next, an operation when the black head 7 is fixed to the carriage 51 will be described with reference to FIGS. 6A, 6B, 7A, 7B, 8A, and 8B. FIGS. 6A and 6B are cross-sectional views illustrating a state where the black head cover 52*a* is opened and the black head 7 is inserted into the carriage 51.

The black head cover 52*a* is rotatably disposed in the carriage 51. At this time, the black head cover 52*a* is urged in a counterclockwise direction in FIGS. 6A and 6B by the spring force of the spring 56. The abutting portion 521 abuts against apart of the carriage 51, so that a further rotation is prevented and the position is maintained. That is, the black head cover 52*a* is disposed at a second position that enables mounting and removing of the black head 7 with respect to the carriage 51.

Further, the lever 57 is urged in the counterclockwise direction in FIGS. 6A and 6B by a spring force of a lever spring 58. An abutting portion 571 abuts against the abutting portion 521 of the black head cover 52*a* so that the position thereof is maintained.

Further, a rotational axis (a rotation fulcrum) of the lever 57 is configured to be coaxial with a rotational axis (a rotation fulcrum) of the black head cover 52*a*, and the abutting portion 571 is provided at a lower position of the rotation fulcrum thereof. That is, an area 521 which presses the lever 57 of the black head cover 52*a* is disposed at a lower position of the rotation fulcrum of the black head cover 52*a*.

A user inserts the black head 7 into an opening portion formed as the result that the black head cover 52*a* is opened. When inserting the black head 7, an upside direction thereof is regulated by the head set cam 53, and a downside direction and right-and-left direction thereof are regulated by the front cover 55. Accordingly, a user can easily insert the black head 7 into the opening.

Figure 7B:
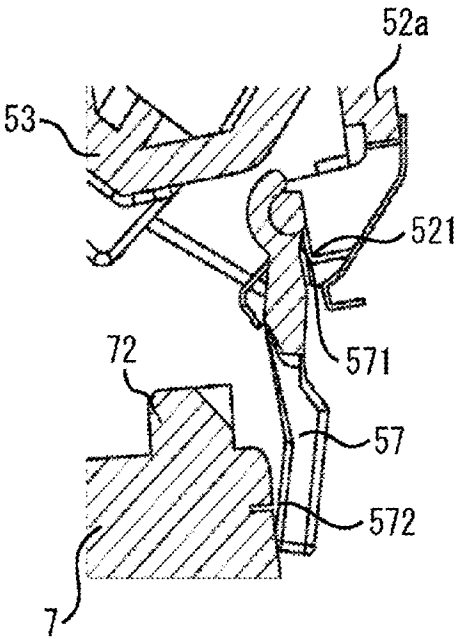
FIGS. 7A and 7B are cross-sectional views illustrating a state where the black head is mounted into an opening portion of the carriage.
Figure 7A:
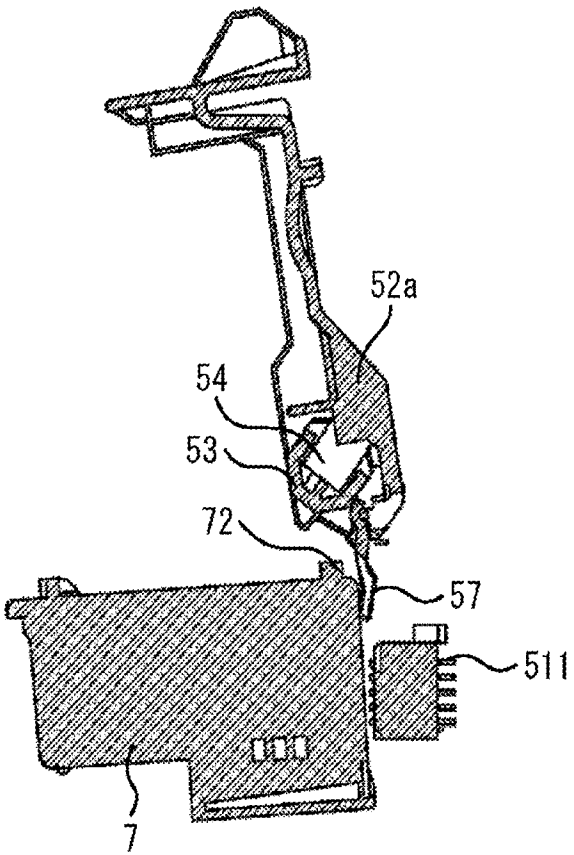

FIGS. 7A and 7B are cross-sectional views illustrating a state where the black head 7 is mounted on the opening portion of the carriage 51. At this time, the black head 7 abuts against three parts (the lever 57, the carriage 51, and the front cover 55), so that a position thereof becomes stable.

The electrode portion 74 at the head side of the black head 7 is spaced apart from the electrode portion 511 of the carriage 51. Accordingly, an electrical connection therebetween is not made, so that any trouble (malfunction) does not occur. Then, the user rotates the black head cover 52*a* in a counterclockwise direction.

Figure 8B:
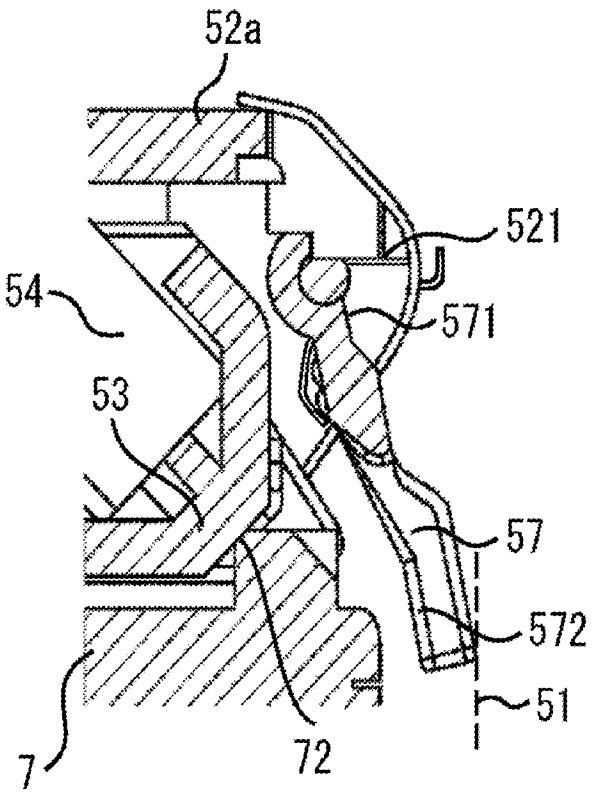
FIGS. 8A and 8B are cross-sectional views illustrating a state where the black head cover is closed and the black head is fixed to the carriage.
Figure 8A:
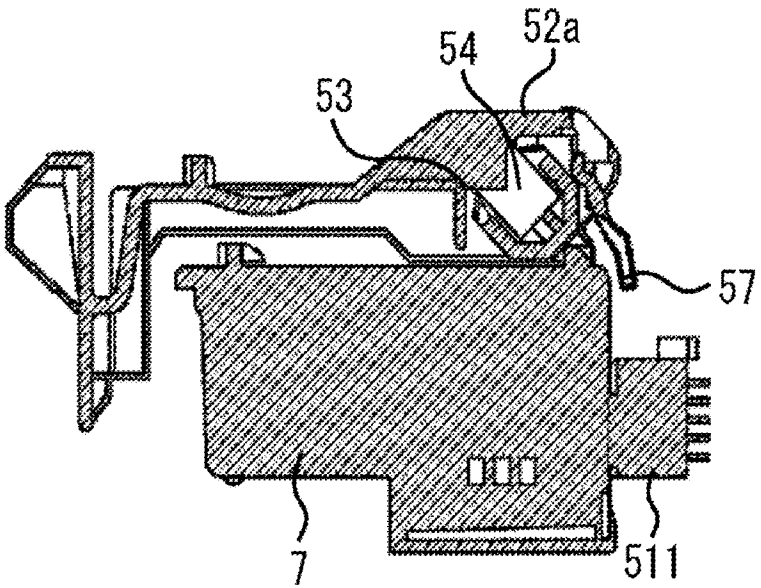

FIGS. 8A and 8B are cross-sectional views illustrating a state where the black head cover 52*a* is closed and the black head 7 is fixed to the carriage 51.

The black head cover 52*a* is fixed at a position where the engaging portion 524 is engaged with the front cover 55. In this state, the black head 7 is fixed to the carriage 51, and recording is performed on the sheet by the black head 7. That is, the black head cover 52*a* is disposed at the first position where the black head 7 is fixed to the carriage 51.

The black head cover 52*a* rotates from the state illustrated in FIGS. 7A and 7B, and thereby the lever 57 is separated apart from the abutting portion 521 of the black head cover 52*a*, and rotates in the counterclockwise direction by the spring force of the lever spring 58.

Then, in the state illustrated in FIGS. 8A and 8B, the lever 57 is located at a position separated from the black head 7, and abuts against a part (wall surface) of the carriage 51 so that a further rotation is prevented and the position becomes stable. Therefore, even if the carriage 5 performs reciprocal movement for recording operation, the lever 57 does not contact the black head 7. Further, the lever 57 is urged by the spring force of the lever spring 58 to the carriage 51. Accordingly, the lever 57 neither rattles nor produces an annoying noise.

The lever 57 rotates with respect to the carriage 51 along with a movement from a first position to a second position of the black head cover 52*a*, and thereby the black head 7 mounted on the carriage 51 is pressed.

Further, the rotation fulcrum of the lever 57 is coaxial with the rotation fulcrum of the black head cover 52*a*. With this configuration, the lever 57 can be arranged in a narrow space surrounded by the carriage 51, the black head cover 52*a*, the head set cam 53, and the black head 7. Thereby the reduction in size of the whole apparatus can be achieved.

Further, in FIGS. 8A and 8B, the abutting portion 521 of the black head cover 52*a* may be disposed at lower position of the rotation fulcrum of the lever 57, or the abutting portion 571 of the lever 57 may be disposed at an upper position of the rotation fulcrum of the lever 57.

To make the configuration simple, in the former case, the rotation fulcrum of the lever 57 may be located at the position as high as possible. In the latter case, the rotation fulcrum of the lever 57 may be located at the position as low as possible. The lever 57 may be kept from touching by a user, in a state where the black head 7 is fixed to the carriage 51.

As described above, as the present exemplary embodiment, configuring the rotational axis (rotation fulcrum) of the lever 57 to be coaxial with that of the black head cover 52*a* will lead to an optimal configuration. Additionally, the color head 8 and the color head cover 52*b* are configured in a similar way.

Next, an operation when the black head 7 is removed from the carriage 51 will be described with reference to FIGS. 9A, 9B, 10A, and 10B.

Figure 9B:
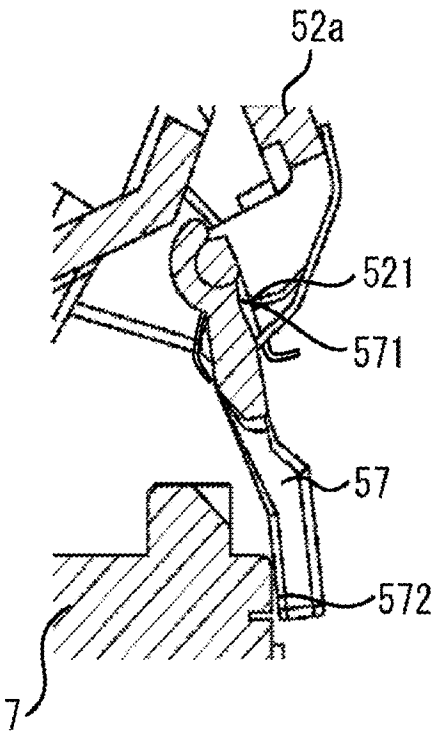
FIGS. 9A and 9B are cross-sectional views illustrating a state where the black head cover is rotated by a predetermined amount from a state where the black head is fixed to the carriage.
Figure 9A:
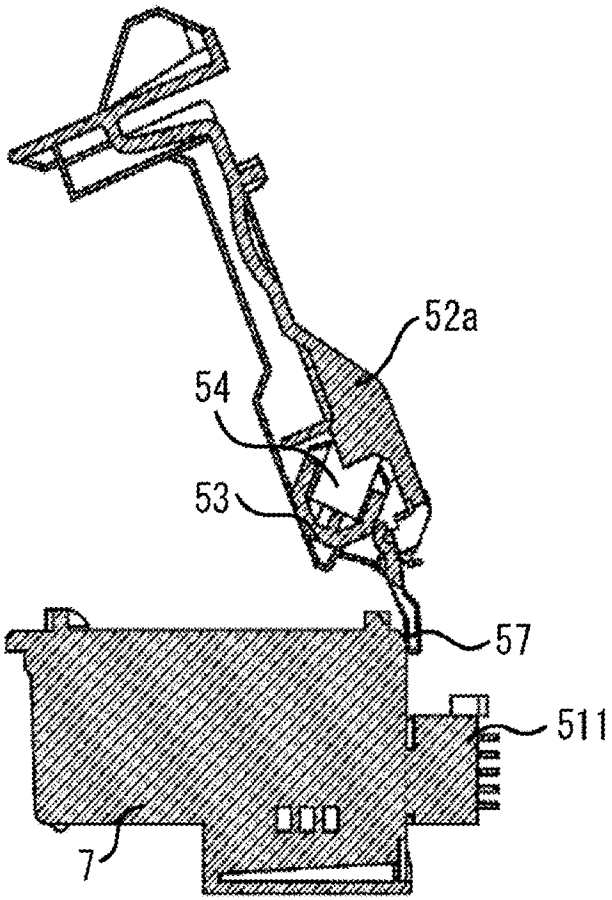

FIGS. 9A and 9B are cross-sectional views illustrating a state where the black head cover 52*a* is rotated by a predetermined amount from a state where the black head 7 is fixed to the carriage 51.

A user presses the operation portion 522 of the black head cover 52*a* in a state of FIGS. 8A and 8B, so as to release an engagement between the black head cover 52*a* and the front cover 55, and to rotate the black head cover 52*a* in a clockwise direction. Since the spring force of the spring 56 acts, as described above, the black head cover 52*a* may be rotated by the spring force if the user takes off the fingers at a position where the engagement is released.

In the state illustrated in FIGS. 9A and 9B, the lever 57 also rotates along with a rotation of the black head cover 52*a*, and a head-abutting portion 572 of the lever 57 is in contact with the black head 7.

Now, the head set cam 53 is separated from the black head 7. However, a positioning portion 71 of the black head 7 remains urged to the carriage 51 by a pressure of a pin of the electrode portion 511 of the carriage 51. Thus, to remove the black head 7, the black head 7 from the state illustrated in FIG. 9 is moved by the lever 57.

Figure 10B:
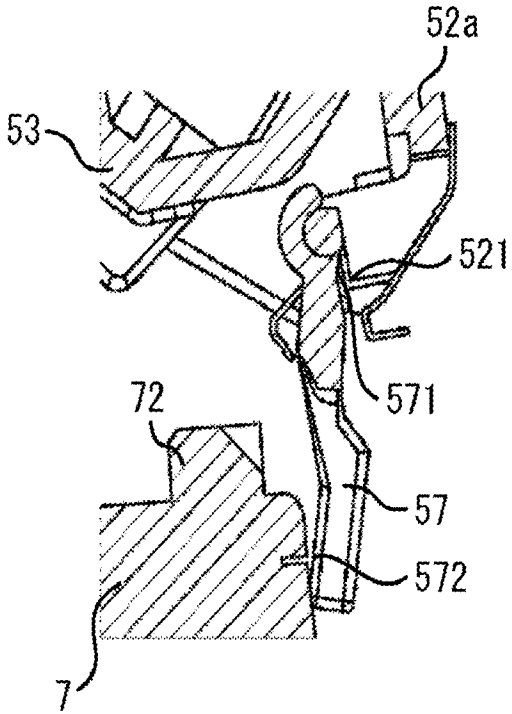
FIGS. 10A and 10B are cross-sectional views illustrating a state where the black head cover is further rotated and the black head cover is fully opened.
Figure 10A:
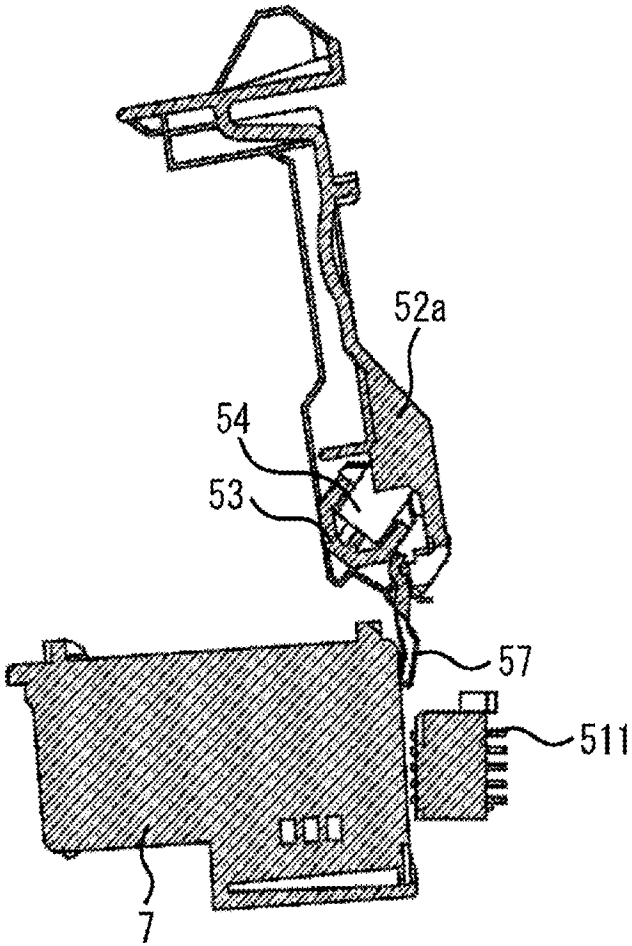
Figure 11A:
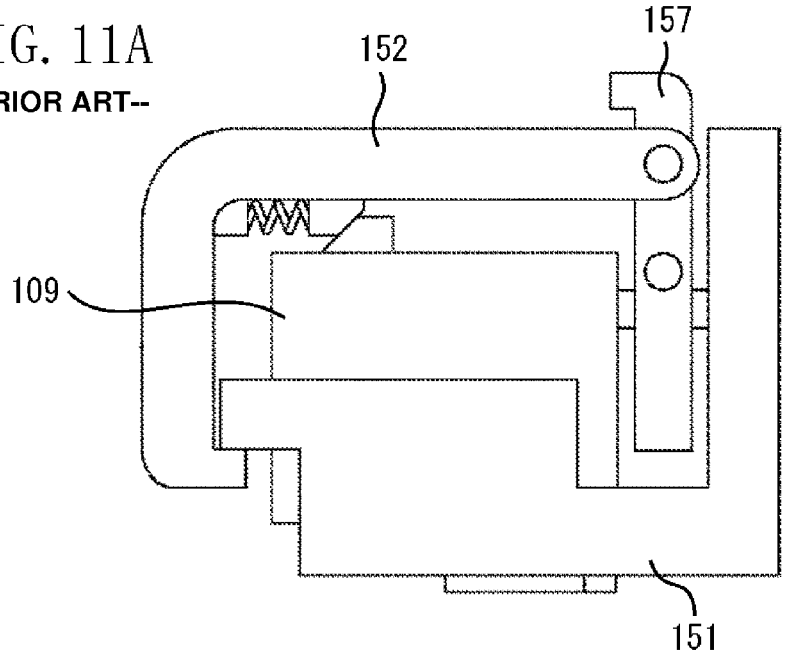
FIGS. 11A and 11B illustrates a mounting mechanism of the recording head in the conventional recording apparatus.
Figure 11B:
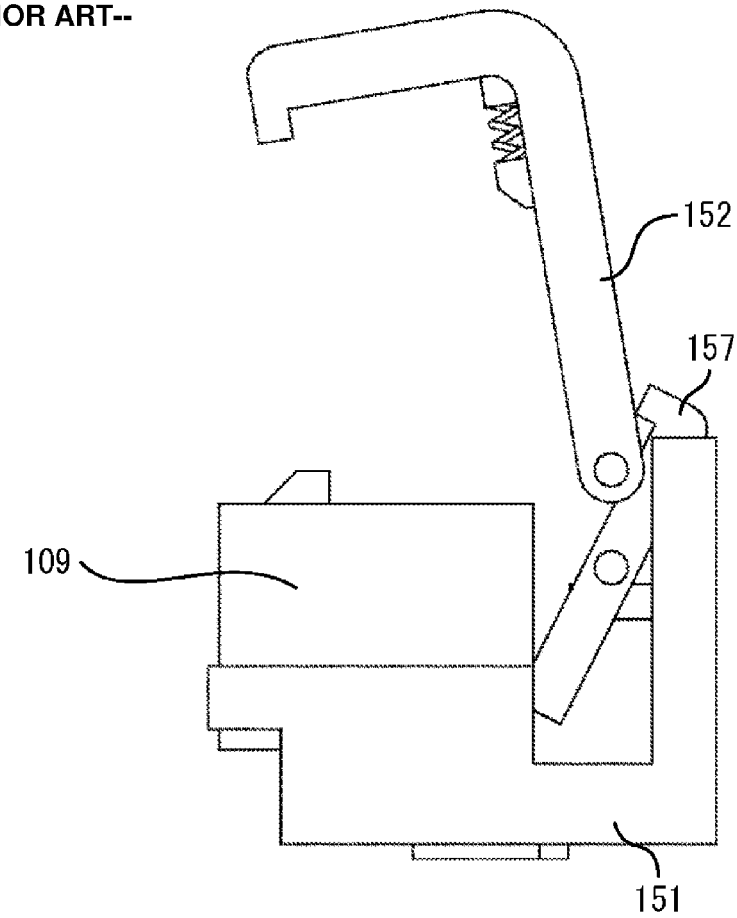

FIGS. 10A and 10B are cross-sectional views illustrating a state where the black head cover 52*a* is fully opened by further rotating the black head cover 52*a* from the state illustrated in FIGS. 9A and 9B. In other words, the black head cover 52*a* is rotatably disposed on the carriage 51, and is movable to a first position where the black head 7 is fixed to the carriage 51 and to a second position where mounting and removing of the black head 7 with respect to the carriage 51 are allowed.

By rotating the black head cover 52*a* from the state illustrated in FIGS. 9A and 9B, the black head 7 is pushed by the lever 57 and moved. In the state illustrated in FIGS. 10A and 10B, the black head cover 52*a* abuts against a part of the carriage 51, so that the rotation thereof is stopped.

In this state, the electrode portion 74 at the head side of the black head 7 and the electrode portion 511 of the carriage 51 are separated from each other, and thus a user can remove the black head 7 from the carriage 51.

According to the exemplary embodiment as described above, the head cover 52 can press the lever 57 at lower position of the rotation fulcrum of the lever 57. Therefore, it is possible to provide a recording apparatus that enables recording of an image with a high quality while securing an operability of mounting and removing of the recording head with respect to the carriage, without the lever protruded from the top surface of the head cover, which is different from the conventional example.

While the present invention has been described with reference to the exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-204515 filed Aug. 7, 2008, which is hereby incorporated by reference herein in its entirety.

What is claimed is:

1. A recording apparatus comprising:

a carriage on which a recording head is removably mounted;

a cover, provided rotatably on the carriage, configured to be movable to a first position where the recording head is fixed to the carriage and to a second position where the recording head can be mounted on or removed from the carriage; and a lever configured to be rotatable independently of the cover, and to press the recording head mounted on the carriage by rotating with the cover pushed by a part of the cover when the cover is moved from the first position to the second position, wherein a rotational axis of the lever and a rotational axis of the cover are coaxial with each other.

2. The recording apparatus according to claim 1, further comprising a spring configured to urge the lever in a direction in which the lever abuts against the recording head.

3. The recording apparatus according to claim 2, wherein when the cover is moved from the second position to the first position, the lever is separated from the recording head so as to rotate relative to the cover against an urging force generated by the spring.

4. The recording apparatus according to claim 3, wherein the recording head and the carriage have electrodes respectively, and the electrodes of the recording head and the carriage contact each other when the recording head is fixed to the carriage and the cover is at the first position.

5. The recording apparatus according to claim 4 wherein the electrodes of the recording head and the carriage do not contact each other when the cover is at the second position.

6. The recording apparatus according to claim 1, wherein a portion that presses the lever of the cover is disposed at a lower position of the rotational axis.

7. The recording apparatus according to claim 1, wherein the carriage is capable of mounting a black head and a color head.

8. The recording apparatus according to claim 7, wherein the black head and the color head are mounted at different positions in a conveying direction of a sheet with respect to the carriage.

9. The recording apparatus according to claim 8, wherein the cover includes a black head cover configured to fix the black head to the carriage, and a color head cover configured to fix the color head to the carriage, and the black head cover and the color head cover are disposed at a similar position in the conveying direction.

10. The recording apparatus according to claim 1, wherein the recording head performs recording using an ink jet process.

11. The recording apparatus according to claim 1, wherein the lever doesn't protrude from a top surface of the cover when the cover is at the first position.

* * * * *